US006058953A

United States Patent [19]

Stefanelli

[11] Patent Number: 6,058,953

[45] Date of Patent: May 9, 2000

[54] WALKING AID WITH RETRACTABLE PICKUP DEVICE

[75] Inventor: Anthony Stefanelli, Belvidere, Ill.

[73] Assignee: Charles Burns, Milford, N.H.

[21] Appl. No.: 09/192,727

[22] Filed: Nov. 16, 1998

[51] Int. Cl.[7] ..... A45B 3/00

[52] U.S. Cl. ..... 135/66; 135/70; 135/75; 135/84; 294/19.1

[58] Field of Search ..... 294/19.1; 135/65, 135/66, 70, 75, 77, 84

[56] References Cited

U.S. PATENT DOCUMENTS

| | | | |
|---|---|---|---|
| 1,905,076 | 4/1933 | Van Sciver | 135/66 |
| 2,346,038 | 4/1944 | Mason | 135/66 X |
| 2,836,188 | 5/1958 | Jordan | 135/66 |
| 2,891,811 | 6/1959 | Strickler . | |
| 3,146,015 | 8/1964 | Roberge . | |
| 3,265,429 | 8/1966 | Shatt . | |
| 3,763,872 | 10/1973 | Gooley | 135/66 |
| 4,091,828 | 5/1978 | Jorgensen | 135/66 |
| 4,200,322 | 4/1980 | Smith . | |
| 4,299,246 | 11/1981 | Marsh | 135/66 |
| 4,758,035 | 7/1988 | Shimasaki . | |
| 4,811,750 | 3/1989 | McAllsiter | 135/66 |
| 4,962,957 | 10/1990 | Traber . | |
| 4,977,914 | 12/1990 | Smerker . | |
| 5,192,104 | 3/1993 | Lin . | |
| 5,232,256 | 8/1993 | Forbes . | |
| 5,351,704 | 10/1994 | Hunnicutt, Jr. et al. . | |
| 5,392,800 | 2/1995 | Sergi . | |
| 5,554,975 | 9/1996 | Hall et al. . | |
| 5,636,650 | 6/1997 | Kroeze . | |
| 5,640,985 | 6/1997 | Snyder et al. . | |

FOREIGN PATENT DOCUMENTS

| | | |
|---|---|---|
| 906092 | 12/1945 | France . |
| 998788 | 7/1965 | United Kingdom . |

*Primary Examiner*—Robert Canfield
*Attorney, Agent, or Firm*—Davis and Bujold

[57] ABSTRACT

A cane (2) having a hollow shaft (4) with a handle (6) secured to one end of the hollow shaft (4) and a pivoted arm (38) being supported adjacent the opposite end of the hollow shaft (4). The pivoted arm (38) is connected to a trigger mechanism (80), located at adjacent the handle (6), via a pair of overlapped internal coupling mechanisms (34, 60, 62, 64, 70, 72, 74) which facilitate adjustment of the axial length of the coupling between the pivoted arm (38) and a trigger mechanism (80). The pivoted arm (38), when in a retracted position, is at least partially housed within a second end of the shaft (4) and axially spaced from the second opposed end of the shaft (4). The pivoted arm (38), when in an extended position, is able to abut against and sweep across a desired floor or surface to facilitate retrieving a desired object (O). A spring biased detent button (98) is provided for retaining the pivoted arm (38) in its retracted position while a spring arrangement (43) biases the pivoted arm (38) toward its operative position.

17 Claims, 7 Drawing Sheets

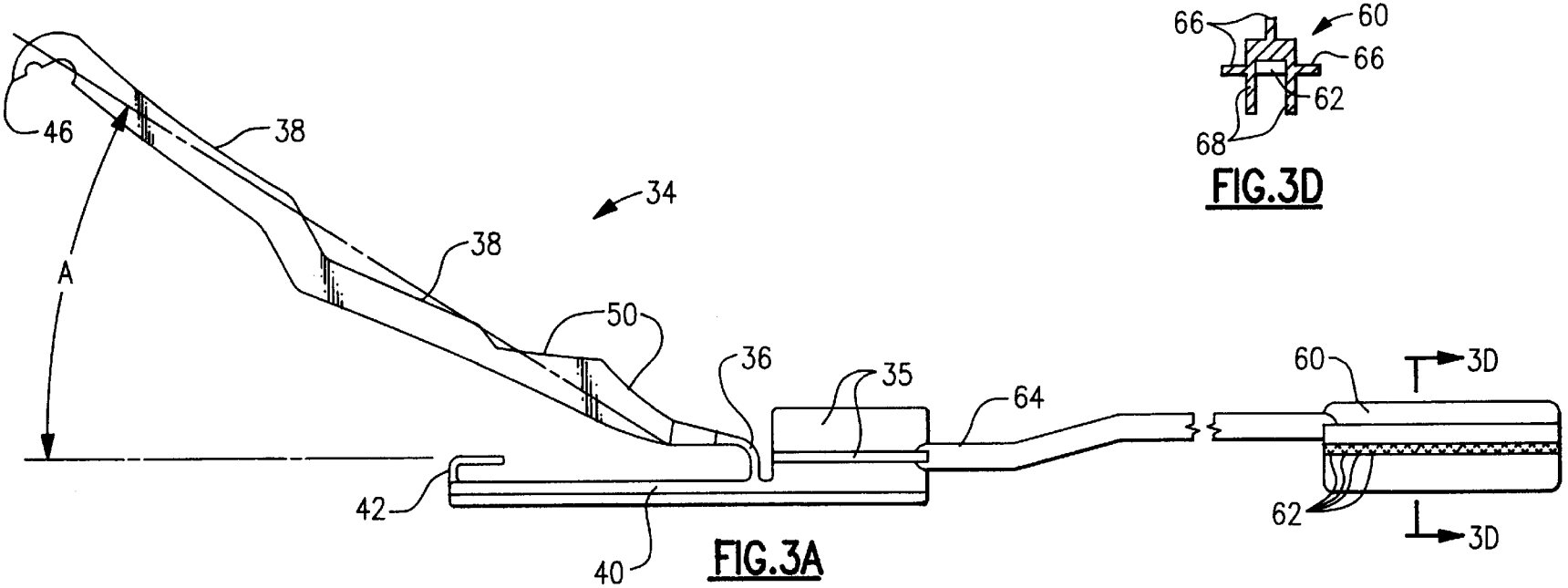
FIG.3A
FIG.3D
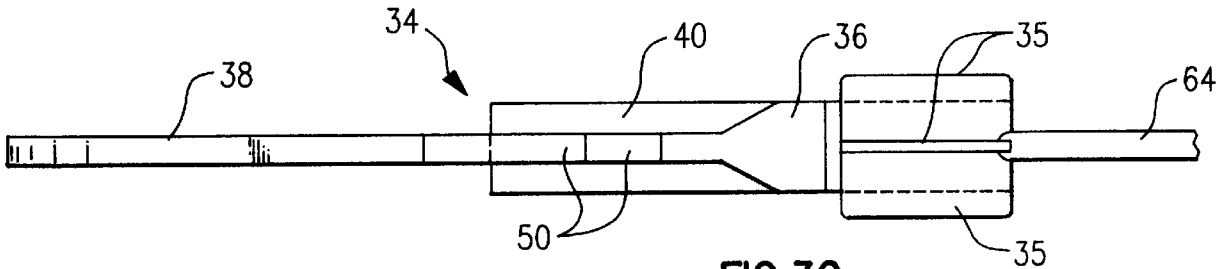
FIG.3C

WALKING AID WITH RETRACTABLE PICKUP DEVICE

FIELD OF THE INVENTION

This invention relates to a walking aid with retractable pickup device enabling a person to pick up and dexterously handle objects and perform certain tasks which their physical condition may not otherwise permit them to do without such aid. In particular, this invention relates to an adjustable articulatable walking aid having an articulatable arm capable of curvilinear motion and precise handling of objects.

BACKGROUND OF THE INVENTION

It is well known in the healthcare industry that when one is injured, aged or physical impaired, the use of a cane, a crutch or some other similar such walking aid is often required to assist an individual, a patient or incapacitated person in their daily activities. Walking aids which have in the past been designed to assist a user to perform general daily functions beyond the aspect of merely physically supporting the user are also known in the art. Several related prior art references, described below, reveal some type of gripping mechanism, however these aids are cumbersome, awkward or inarticulate and do not adequately meet the needs of a person utilizing such devices. In particular, articles such as coins, buttons, paper or other small difficult to handle objects, which often lie flat or are relatively planar in shape, present significant problems to a person attempting to retrieve such object with the previous unwieldy devices. Such a dilemma presents a tremendous and frustrating problem to a person who cannot retrieve such objects or articles without some help or assistance.

U.S. Pat. No. 5,640,985 to Snyder et al. reveals an adjustable length cane with a grasping apparatus adjacent the base of the cane. While this cane reveals the basic concept of grasping an article at the far length of the cane by the use of a grasping arm, the grasping arm is exposed when not in use and has a fixed pivot point and fixed, predetermined grasping motion. In addition, although the cane of Snyder et al. is adjustable, adjustment of the cane shaft and the integral actuating mechanism for the grasping arm must be performed in entirely separate operations.

U.S. Pat. No. 5,636,650 to Kroze discloses an adjustable cane with built in pick-up means. The built in pick-up means of Kroze is a swingably hinged arm which is retractable within the sleeve or bottom shaft of a telescoping cane. Similar to Snyder, Kroze discloses a fixed swingably pivoting grabbing arm rotating in a singular fixed predetermined arc from its retracted position to its engagement position. Kroze's shaft also may be lengthened via a telescoping tubular shaft, however, the use of an elastomer or stretching portion of the actuating cable is utilized. The use of such an elastic actuating cable presents significant problems relating to the control and force with which the pick-up arm is controlled. Due to this type of design, a certain portion of the energy utilized to move the pickup arm will be absorbed by the actuating cable thus decreasing the users control, force and feel with respect to the object.

Another similar pick-up arm is revealed in U.S. Pat. No. 5,392,800 to Sergi which reveals a multi-purpose cane device, in particular a grabbing arm at the base of a cane. However, this device and many others like it including U.S. Pat. No. 2,836,188 to Jordan again merely reveal a fixed pivoting grabbing arm, which pivot about a single axis in one particular fixed predetermined curve and, in addition, these references do not account for adjustment not only regarding the length of the cane, but in particular, adjusting the control mechanism of the grabbing arm.

The related art reveals a lack of adroitness in the handling of objects as well as the ease of use and adjustment of the length of the walking aid particularly required by individuals, patients or incapacitated persons. Previous gripping or grasping arms or devices display a particular lack of agility in handling small precise articles.

SUMMARY OF THE INVENTION

Wherefore, it is an object of the present invention to overcome the aforementioned problems and drawbacks associated with the prior art designs.

In particular, the present invention overcomes the lack of dexterity inherent in the related prior art by providing an adroit pick up pivoted arm for use in combination with a walking aid and further discloses a novel and simple adjustment mechanism for varying the length of the walking aid and the trigger mechanism of the pick up arm requiring mere adjustment of the shaft length of the walking aid.

Accordingly, it is the object of the present invention to provide a novel and improved walking aid with a retractable pick-up device enabling an individual, a handicapped or an incapacitated person to dexterously handle any object, and in particular retrieve small, unmanageable articles from any surface.

It is the further object of the this invention to provide an articulatable walking aid comprising a hollow shaft having a top segment and a bottom segment defining a top end and a bottom end respectively, the top end having a handle configured for a walker's hand, the bottom end having a slip resistant butt end, an trigger mechanism extending outwardly from within the hollow shaft via an aperture adjacent the top end of the shaft, an articulating arm also outwardly extending from within the shaft via a slot adjacent the bottom end, an actuating rod positioned within the hollow shaft, the rod extending generally along a longitudinal axis and communicating with the trigger mechanism and the articulating arm, the articulating arm having a curvilinear range of motion wherein activation of the trigger mechanism by the walker initiates a curvilinear sweeping of the arm from a retracted, biased position to an extended, object engaging position.

It is an even further object of the invention to provide a walking aid as set forth above wherein the top and bottom segments are separate elements having a telescopically engaging fit to facilitate an adjustment in length of the hollow shaft, the walking aid further comprising, a locking mechanism for securely immobilizing the upper and lower telescoping segments in a fixed position relative to one another, and the actuating rod having an adjustment mechanism contemporaneously functioning with any adjustment in length between the upper and lower segments wherein the actuating rod retains a suitable length ensuring continued proper communication and functioning between the actuating mechanism and the articulating arm.

Another object of the invention includes the walking aid as set forth above wherein the bottom segment includes a cam integral with the slot adjacent the bottom end, the cam having an influential contact with a camming surface of the pivoted arm wherein the range of motion of the pivoted arm is defined by an interaction between the cam and camming surface.

BRIEF DESCRIPTION OF THE DRAWING(S)

The invention will now be described, by way of example, with reference to the accompanying drawings in which:

FIG. 3A is a diagrammatic front view showing a pick up arm according to the present invention;

FIG. 3C is a diagrammatic top plan view of the pick up arm of FIG. 3A;

FIG. 3D is a diagrammatic cross-sectional view along section line 3D—3D of FIG. 3A;

FIG. 4C is a diagrammatic cross-sectional view along section line 4C—4C of FIG. 4B;

DESCRIPTION OF THE PREFERRED EMBODIMENT(S)

Figures 1, 1A:
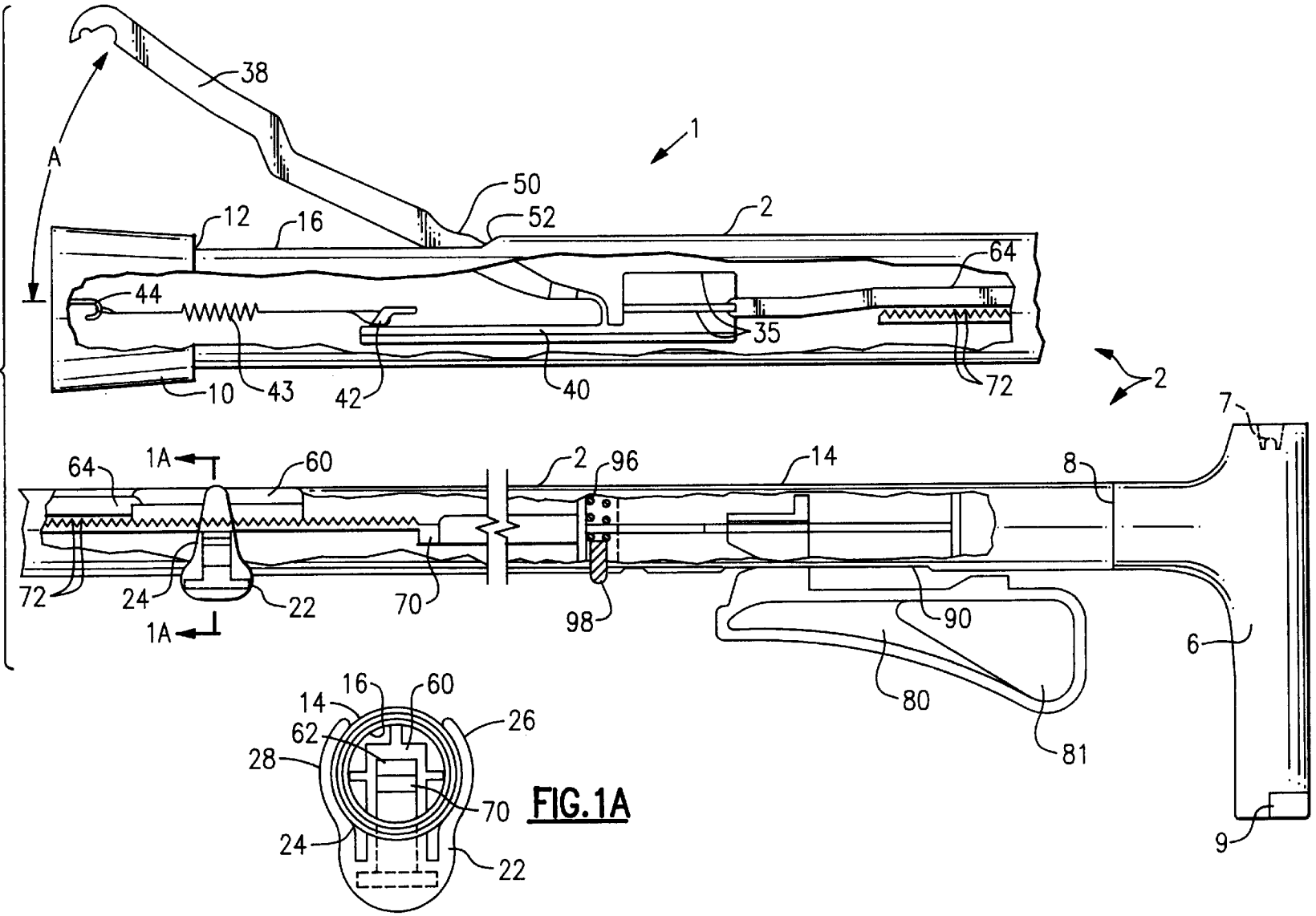
FIG. 1 is a diagrammatic view showing the upper and lower portions partially in section of the cane according to the present invention.
FIG. 1A is a diagrammatic cross-sectional view along section line 1A—1A of FIG. 1B.
Figures 2A, 2B:
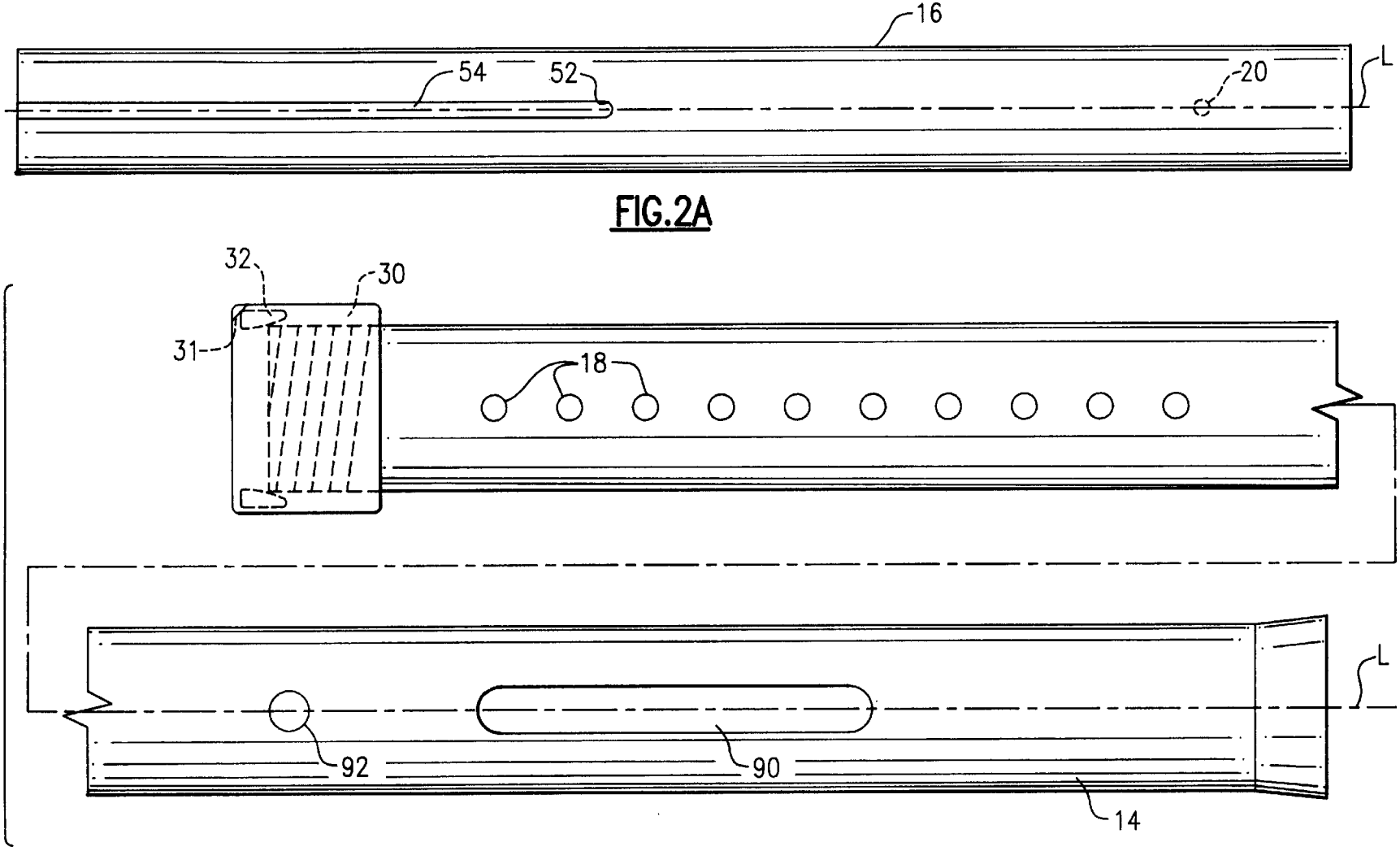
FIG. 2A is a diagrammatic view of a lower portion of the cane according to the present invention.
FIG. 2B is a diagrammatic view of an upper portion of the cane according to the present invention.

A walking aid 1, according to the present invention, can be generally seen in FIGS. 1, 2A and 2B. The walking aid 1 comprises a cane 2 which is generally a hollow longitudinal shaft 4 which permanently supports a handle 6 at a top first end thereof 8 and also supports a rubber or some other non-slip cover or overcap 10, at the bottom end 12 thereof. The shaft 4 can be manufactured from any known or conventional material such as wood or metal, e.g., steel, aluminum, stainless steel etc., or more sophisticated materials such as carbon fiber, fiberglass, laminates or light weight alloys. Preferably, the shaft 4 is sufficiently hollow to provide ample space or area for the internal components of the cane 4, and a further detailed description concerning the function and operation of the internal components will follow.

The handle 6 is preferably made of the same material as the cane 2 but could, if so desired, be manufactured from a different material. The handle 6 is designed to increase the visual appearance of the cane 2, to improve the safety of a user, e.g. it may be equipped with a front switchable safely light 7 and a rear switchable safely light 9 (only diagrammatically shown), and/or to provide a more ergonomically comfortable gripping surface for the hand of a user. The walking aid 1, according to the present embodiment, closely resembles a classic walking cane and the novel features of the present invention, as will be readily apparent from the following description, is equally applicable to related devices such as a pair of crutches and a staff. As the above described components of the cane 2 are conventional and well known in this art, a further detailed description concerning the same is not provided.

According to a preferred embodiment of the invention, the axial length L of the shaft 4 is adjustable (FIGS. 2A and 2B), e.g. telescopically or otherwise adjustable. To facilitate such adjustment, the shaft 4 is formed as two separate components, e.g. a first segment 14 and a second segment 16. The first segment 14 in provided with a plurality of sequentially arranged adjustment holes 18 provided on the exterior surface thereof, e.g. a series of about eight to ten or so adjustment holes, each being spaced about an inch or so apart from any adjacent hole 18, while the second segment 16 has a single adjustment hole 20 which is alignable with a desired one of the plurality of adjustment holes 18 provided in the first segment 14. A locking collar 22 (FIG. 1A) is provided with an inwardly facing locking pin 24 which is sized to easily pass through the two aligned adjustment holes 18, 20 of the first and second segments 14, 16 and thereby prevent further relative movement between those two segments. It is to be appreciated that locking pin 24 has to be of a sufficiently small diameter to allow passage through the two aligned adjustment holes 18, 20 but also must protrude therethrough a sufficient distance to maintain the engagement with the two aligned adjustment holes 18, 20 and thus prevent any undesired relative movement between the two segments once the locking collar 22 encases the first segment 14.

As can be seen in FIG. 1A, locking collar 22 is provided with a pair of spaced apart legs 26,28 which each have an inwardly facing curved surface which closely receives, snugly surrounds and encases the outer surface of the first segment 14 to retain the locking collar 22 in secure engagement with the first segment 14. When adjustment of the longitudinal length L of the cane 2 is desired, the locking collar 22 is pried off or otherwise removed from its engagement with the first segment 14 and in doing so removes the locking engagement between the first segment 14 and the second segment 16. Thereafter, the single adjustment hole 20, provided in the second segment 16, is freely alignable with a desired one of the adjustment holes 18 provided in the first segment 14. Once the desired realignment has occurred, the locking pin 24 of the locking collar 22 is then passed through the two aligned holes 18, 20 and the pair of spaced apart legs 26, 28 are initially spread apart from one another and then snap or wrap around or about the outer peripheral surface of the first segment 14 to securely retain the locking collar 22 about the first segment 14 while the locking pin 24 prevents relative movement between those two segments 14, 16.

To further assist with preventing relative movement between the first segment 14 and the second segment 16, as well as to reduce or minimize any chatter or rattle occurring between those two segments, the first segment 14 has an external thread (not separately numbered) which is sized to mate with an internal thread (not separately numbered) of a mating knurl 30. In addition, the knurl 30 has an inwardly tapered surface 31, facing the bottom end 12 of the cane 2, which is orientated to engage with a split ring 32 accommodated within the knurl 30. Due to this arrangement, and as the knurl 30 is gradually threaded onto the first segment 14, the inwardly tapered surface 31 of the knurl 30 causes the split ring 32 to be biased against an end face of the first segment 14 which induces an inner diameter of the split ring 32 to be gradually reduced. Such gradual reduction of the inner diameter of the split ring 32 compresses the split ring 32 about and around the exterior surface of the second segment 16, when received within the first segment 14, to thereby clamp the second segment 16 relative to the first segment 14. As such clamping action is conventional and well known in the art, a further detailed description concerning the same is not provided.

The cane 2 is provided with a retractable articulated pick up arm 34 which is supported adjacent bottom end 12 of the cane 2. The articulated pick up arm 34 at least partially extends out through a slot 54, provided in the second segment 16 and is able to pick up a variety of different objects O which may be difficult to retrieve or are not readily accessible by a user of the cane 2. A further detailed description concerning operation of the articulated pick up arm 34 will follow below.

Figures 6A, 6B, 6C, 6D:
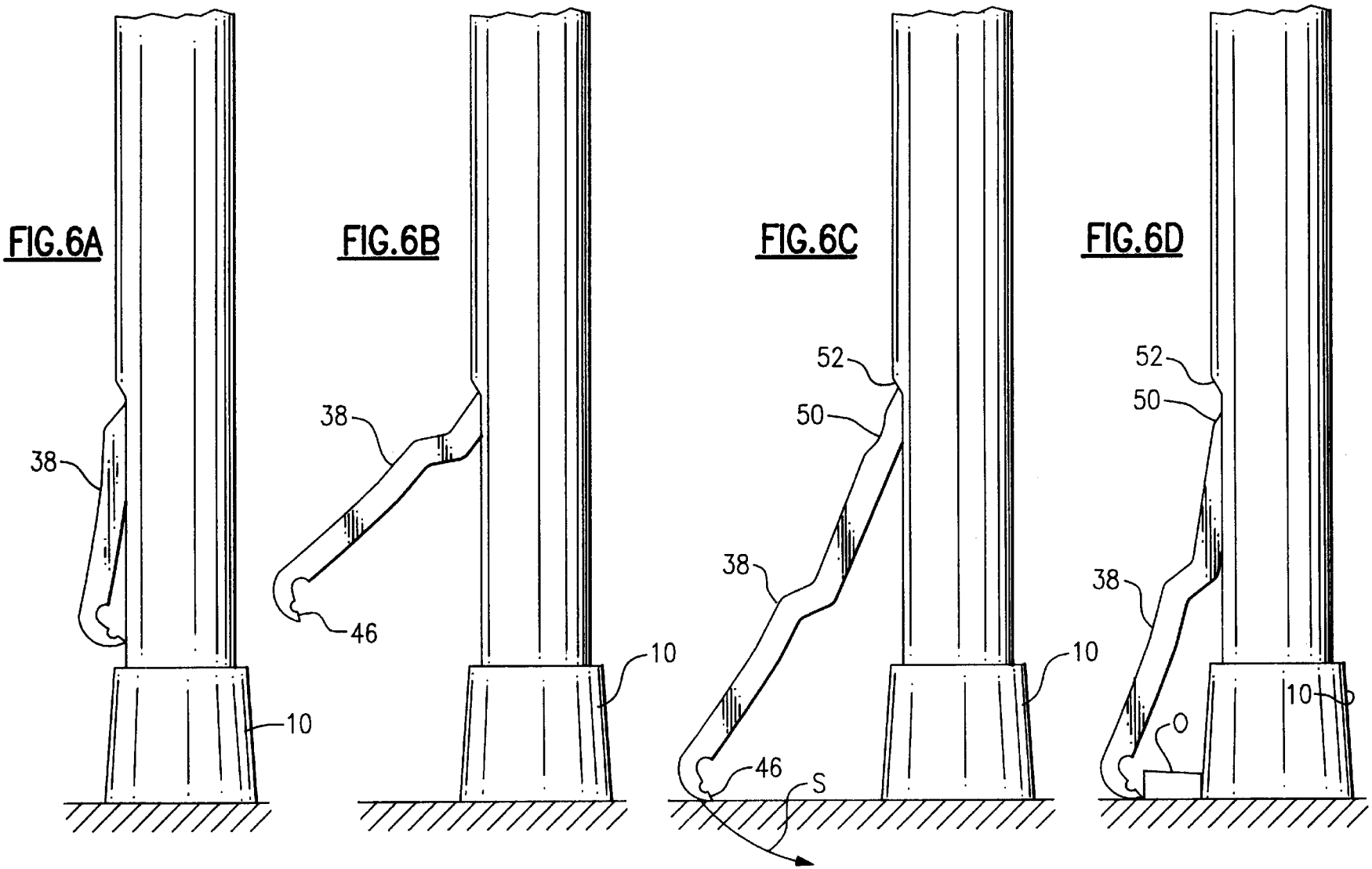
FIG. 6A is a diagrammatic view of a lower portion of the cane, according to the present invention, showing the pick up arm in its fully retracted position.
FIG. 6B is a diagrammatic view of a lower portion of the cane, according to the present invention, showing the pick up arm in its partially extended position.
FIG. 6C is a diagrammatic view of a lower portion of the cane, according to the present invention, showing the pick up arm in its fully extended position prior to retraction by the trigger mechanism.
FIG. 6D is a diagrammatic view of a lower portion of the cane, according to the present invention, displaying the pick up showing its sweeping motion for grasping a desired object.

The articulated pick up arm 34 is connected to a trigger mechanism 80 to facilitate control thereof by a user of the cane 2. With reference to FIGS. 1, and 3A–3D, it can be seen that the articulated pick up arm 34 comprises a pivoted arm 38 and a stationary arm 40 which are pivotably coupled to one another by a pivot section 36 located at a V-shaped apex of the articulated pick up arm 34. The pivot section 36 allows the pivoted arm 38 to flex inwardly and outwardly toward and away from the stationary arm 40 to provide the desired motion. That is, when the articulated pick up arm 34 is in its lower most position, the pivoted arm 38 extends outwardly away from bottom end 12 of the cane 2, as can be seen in FIG. 6C, due to the natural or inherent resiliency of the articulated pick up arm 34. The articulated pick up arm 34 is provided with a plurality, e.g. three or four, centering rails 35 which facilitate maintaining the articulated pick up arm 34 centered within the hollow shaft 4 during its to and fro axial motion.

FIG. 3A shows the natural uncompressed orientation of the articulated pick up 34, e.g., the pivoted arm 38 forms an angle A of about 30° with the stationary arm 40. To facilitate movement of the articulated pick up arm 34 into this extended position, the stationary arm 40 of the articulated pick up arm 34 is provided with an integral hook 42. A first end of a rubber band, a biasing member or a spring 43 is connected to the hook 42 while a second end of the spring 43 is connected to a second hook 44 permanently secured to the lower most extremity or bottom end 12 of the second segment 16 (not shown in detail) or possibly to the non-slip cap 10. The spring 43 biases the articulated pick up arm 34 toward the lower most extremity or bottom end 12 of the second segment 16 while the trigger mechanism prevents the articulated pick up arm 34 from being moved too far in the direction toward the non-slip cap 10 and a further discussion concerning such limiting action will follow below.

A free end of the pivoted arm 38 is provided with a hook shape grasping portion 46 to facilitate grasping of a desired object O to be retrieved. If desired, a rubber or other non-slip tip may be permanently secured, e.g. glued, on or over the hook shape grasping portion 46 to facilitate a grasping of a desired object O. An outwardly facing surface of an intermediate portion of the pivoted arm 38 is provided with a cam follower ridge 50 which engages with a cam surface 52 located at an end of the slot 54 provided in the second segment 16. A further detailed description concerning the purpose and function of the cam follower ridge 50 and the cam surface 52 will follow.

Figure 4B:
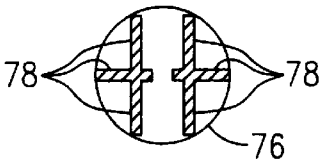
FIG. 4B is a diagrammatic view of FIG. 4A rotated 90° along its longitudinal axis.
Figure 4A:
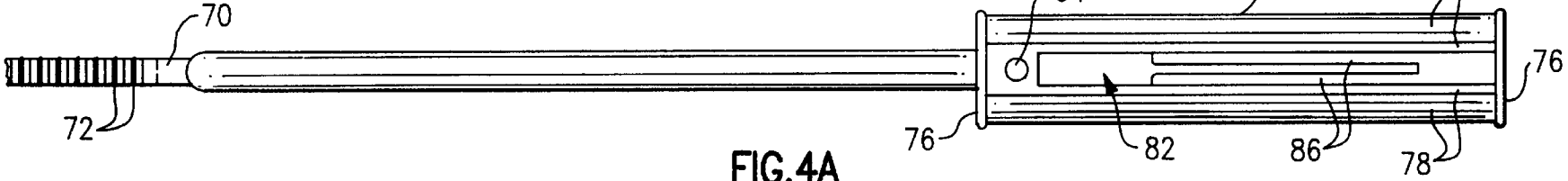
FIG. 4A is a diagrammatic perspective view showing a trigger housing, according to the present invention, which mates with a trigger mechanism.
Figure 4B:
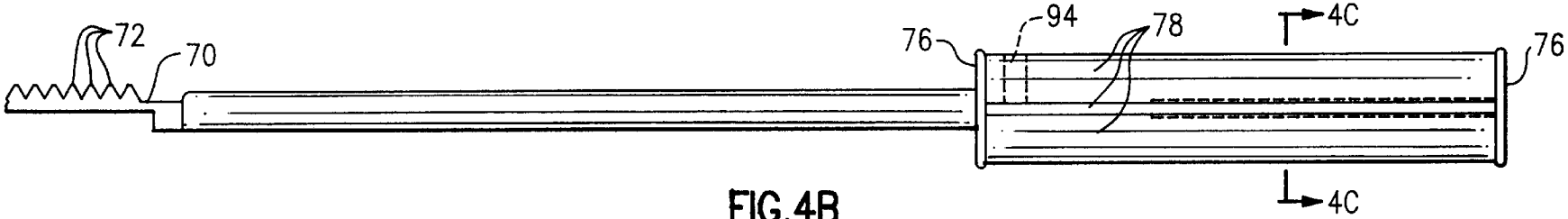
Figure 3B:
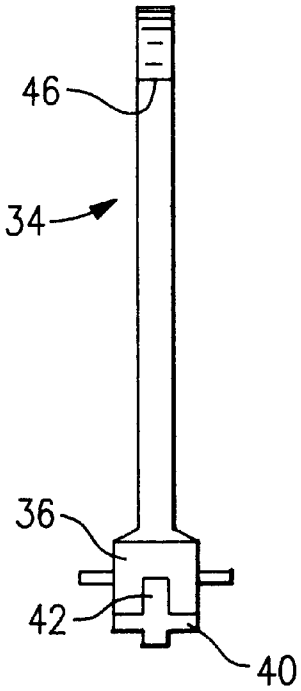
FIG. 3B is a diagrammatic left end view of the pick up arm of FIG. 3A.

A breach housing 60, containing a plurality of saw tooth serrations or jagged teeth 62, is connected to the articulated pick up arm 34 via a first connecting rod 64. The first connecting rod 64 has a length of about nine inches or so and it is to be appreciated that the length of the connecting rod 64 can vary from application to application. As can be seen in FIG. 3D, the breach housing 60 is provided with a plurality, e.g. three or four, centering rails 66 as well as a pair of opposed guiding walls 68. The pair of guiding walls 68 are spaced apart from one another a sufficient distance to closely receive a mating second connecting rod 70 (FIGS. 4A and 4B) provided with a plurality of mating saw tooth serrations or jagged teeth 72 provided along a first adjacent surface thereof. The mating jagged teeth 72 are sized to intimately engage with and be retained by the jagged teeth 62 of the breach housing 60 to prevent relative movement therebetween. The location at which the mating jagged teeth 72 of the second connecting rod 70 engage with the jagged teeth 62 of the breach housing 60 facilitate an adjustable releaseable coupling varying the axial length of these two components with respect to one another.

The jagged teeth 62,72 must have a sufficient height to allow retention of the engagement between the mating teeth while still allowing a sufficient clearance therebetween to facilitate adjustment of the teeth 62, 72, relative to one another, once the locking collar 22 is removed from the first segment 14.

As can be seen in FIGS. 1 and 1A, for example, the locking pin 24, biases a rear surface of second connecting rod 70 toward the breach housing 60 to maintain the engagement between the mating teeth 62, 72 and prevent relative movement between those mating pair of teeth while still allowing the rear surface of second connecting rod 70 move to and fro, within the shaft 4, by sliding along an end face of the locking pin 24.

Figure 5C:
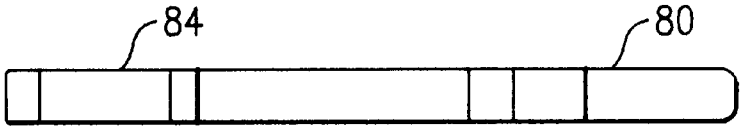
FIG. 5C is a diagrammatic top plan view of FIG. 5A.
Figure 5A:
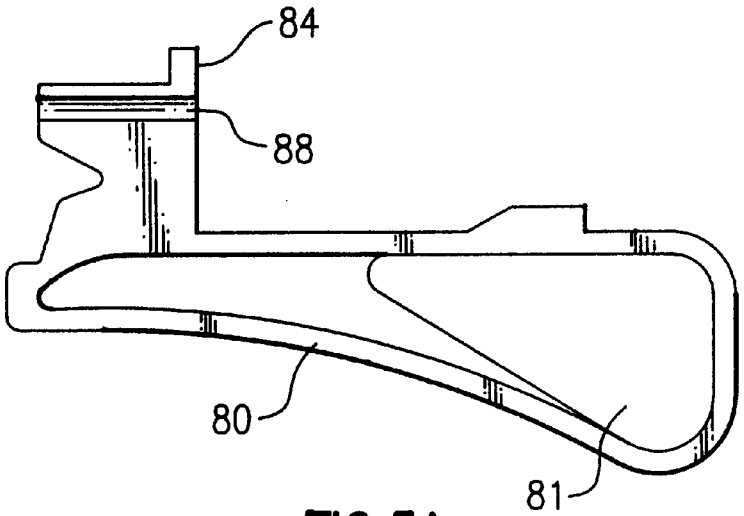
FIG. 5A is a diagrammatic plan view of the trigger mechanism according to the present invention.
Figure 5B:
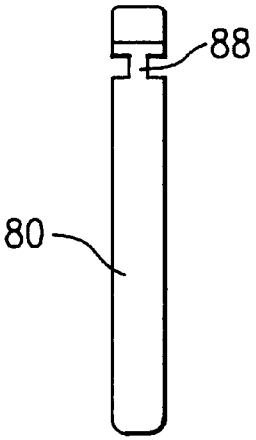
FIG. 5B is a diagrammatic left end view of FIG. 5A.

The second connecting rod 70 is connected to a trigger housing 74. The trigger housing 74 includes a pair of spaced apart circular end walls 76 which are sized to be readily received within the hollow second segment 16 and allow sliding axial movement of the trigger housing 74. In addition, a plurality of centering ribs 78 extend between the pair of spaced apart circular end walls 76 to facilitate maintaining the trigger housing 74 centered within the first segment 14 of the shaft 4. A central area of the trigger housing 74 is provided with a trigger aperture 82 which allows a protruding leg 84 (FIG. 5A) of the trigger mechanism 80 to be received therein. In addition, a pair of opposed guide rails 86 extend between the pair of spaced apart circular end walls 76 and communicate with the trigger aperture 82. The protruding leg 84 is sized to pass through the trigger aperture 82, provided in the trigger housing 74, and has a reduced cross-sectional area 88, e.g. a pair of inwardly facing grooves, which mates with the pair of opposed guide rails 86 to secure the trigger mechanism 80 to the trigger housing 74 but still allowing the trigger mechanism 80 to move relative to the trigger housing 74.

As can be seen in FIG. 1, the trigger housing 74 passes through an elongate trigger slot 90, provided in the first segment 14, adjacent the handle 6, to facilitate to and fro movement of the trigger mechanism 80 relative to the hand 6, and a further detailed description concerning the function and purpose of the relative movement of the trigger mechanism 80 will be provided below. It is to be appreciated that the trigger mechanism 80 can only be passed through the trigger aperture 82, provided in the trigger housing 74, when the trigger housing 74 is in its extreme axial position located adjacent the handle 6 and aligned with the elongate trigger slot 90—the spring 43 normally biases the trigger housing 74 axially downward in an opposite direction toward the bottom end 12. Such biasing action of the spring 43 maintains the trigger mechanism 80 captively retained by the pair of opposed guide rails 86. Further, the protruding leg 84 butts against an inwardly facing surface of the first segment 14 as it is not properly aligned with the elongate trigger slot 90 and thus cannot be removed from its engagement with the trigger housing 74.

The trigger housing 74, the second connecting rod 70 and the mating jagged teeth 72 all form the first internal coupling mechanism. The breach housing 60, the jagged teeth 62, the first connecting rod 64, and the articulated pick up arm 34 all form the second internal coupling mechanism.

A detent aperture 92 (FIG. 2B) is provided in the first segment 14, adjacent the elongate trigger slot 90, but remote from the handle 6. The trigger housing 74 is provided with a cavity or recess 94 (FIGS. 4A and 4B) which accommodates a spring 96 and a detent button 98. The spring 96 is located within the cavity or recess 94 and biases the detent button 98 radially outward against an inwardly facing surface of the first segment 14 of the shaft 4. When the detent button 98 is aligned with the detent aperture 92, the spring 96 forces the detent button 98 partially out through the detent aperture 92 to lock the trigger housing 74 relative to the shaft 4, e.g. when the detent button 98 is locked, the articulated pick up arm 34 is also locked in a fully retracted position at least partially inside the slot 54 such that the pivoted arm 38 is sufficiently spaced away from bottom end 12 of the cane 2 so as not to hinder normal walking operation of the cane 2. When the trigger housing 74 is locked by the detent button 98, it is to be appreciated that the trigger mechanism 80 is still freely movable relative to the trigger housing 74, i.e. the trigger mechanism 80 can slide along the pair of opposed guide rails 86, but is still captively retained.

It is to be appreciated that the detent button 98 is slightly larger than the detent aperture 92, or is provided with a shoulder (not specifically shown), so as to prevent the spring 96 from forcing the detent button 98 completely out through the detent aperture 92. Such arrangement ensures that the detent button 98 is captively retained within the shaft 4.

When the detent button 98 is sufficiently depressed radially inwardly, such that the detent button 98 is cleared of the detent aperture 92, the spring 43 biases the articulated pick up arm 34 axially downwardly toward bottom end 12 of the cane 2. In turn, the trigger housing 74, along with the trigger mechanism 80, are also biased axially downwardly toward bottom end 12 of the cane 2. Such biasing movement causes the trigger mechanism 80 to slide along the pair of opposed guide rails 86 and abut against the circular end wall 76 located adjacent the handle 6. When the trigger mechanism 80 is in such position, any upward movement of the trigger mechanism 80, toward the handle 6, in turn, causes both the first connecting rod 64 and the second connecting rod 70 to move axially toward the handle 6. Such movement causes the cam follower ridge 50 to be guided by the cam surface 52 of the slot 54 and bias the pivoted arm 38 radially inwardly toward the bottom end 12 and the non-slip cap 10 thereby causing the pivoted arm 38 to commence its sweeping motion. Continued movement of the trigger mechanism 80, toward the handle 6, causes further guiding movement of the cam follower ridge 50 along the cam surface 52 until the pivoted arm 38 is brought into contact with a base of the non-slip cap 10.

If the trigger mechanism 80 is continued to be pulled toward the handle 6 by a user, the articulated pick up arm 34 is again retracted within the cam slot 54 of the second segment 16, e.g. moves axially along the shaft 4 to a position space away from the non-slip cap 10. If the trigger mechanism 80 is moved a sufficient distance toward the handle 6, the detent button 98 re-engages with the detent aperture 92 to again retain and lock the articulated pick up arm 34 in its fully retracted position.

If further use of the articulated pick up arm 34 is desired, the trigger mechanism 80 is released, i.e. the detent button 98 is disengaged from the detent aperture 92, and such releasing action allows the spring 43 to return the pivoted arm 38 to its fully extended position (see FIG. 6C) where the hook shape grasping portion 46 of the pivoted arm 38 is located remote from the non-slip cap 10 and is able to retrieve a desired object O. Subsequently, the pivoted arm 38 can recommence its sweeping action (as generally shown by arrow S) upon sufficient activation of the trigger mechanism 80.

With reference to FIGS. 6A–6D, a detailed description concerning the sweeping motion of the pivoting arm 38, toward the non-slip cap 10, will now be provided. When a user of the cane 2 depresses detent button 98, the spring 43 biases the pivoted arm 38 into its extended position (FIG. 6C). As can be seen in FIG. 6B, the spring 43 has only partially biased the pivoted arm 38 toward its partially extended position. During this expanding motion, the cam follower ridge 50 rides or slides across the cam surface 52 and such camming action prevents the pivoted arm 38 from being completely expanded to its initial unbiased state until the spring 43 has sufficiently biased the articulated pick up arm 34 clear of the cam surface 52.

The cam follower ridge 50 continues to slide or glide across the cam surface 52 until the hook shape grasping portion 46 is brought into engagement with a desired floor or surface to be swept across. It is to be appreciated that the cane 2, according to the present invention, is generally able to provide its sweeping or scraping action S provided that the shaft 4 of the cane 2 is in a substantially perpendicular orientation with respect to the floor to be swept across.

The fully lowered position of the pivoted arm 38 is shown in FIG. 6C. Due to this arrangement, when a user moves the trigger mechanism 80 axially toward the handle 6, the articulated pick up arm 34 is moved axially within the shaft 4 toward the handle 6. The cam surface 52 produces a counterclockwise swinging motion S on the free end of the pivoted arm 38 (as seen in FIG. 6C) which maintains the free end of the pivoted arm 38 in engagement with the desired surface to be swept across. This camming action, between the cam follower ridge 50 and the cam surface 52, continues until the hook shape grasping portion 46 is brought into abutment with the non-slip cap 10 so that a flat planar object O can be retrieved, i.e. the object O is sandwiched between the hook shape grasping portion 46 and the non-slip cap 10.

Due to the curved profile of the exterior surface of the pivoted arm 38, once the hook shape grasping portion 46 is brought into an abutment with the non-slip cap 10, the articulated pick up arm 34 is moved axially along the shaft toward its retracted position. Accordingly, the pivoted arm 38 is maintained in engagement with a desired floor to be swept across due to the interaction between the cam follower ridge 50 and the cam surface 52 until the pivoted arm 38 is brought into an abutment with the non-slip cap 10. Thereafter, the pivoted arm 38 is moved axially along the shaft 4. It is to be appreciated that if the trigger mechanism 80 is operated without the non-slip cap 10 abutting against a scraping surface, the pivoted arm 38 will be pivoted to a position below the non-slip cap 10, as shown generally by arrow S in FIG. 6C. Due to the above disclosed arrangement, the pivot axis, i.e. the pivot section 36, of the pivoted arm 38 is axially movable during pivoting of the pivoted arm 38, and not fixedly positioned as with the prior art designs.

Figure 8A:
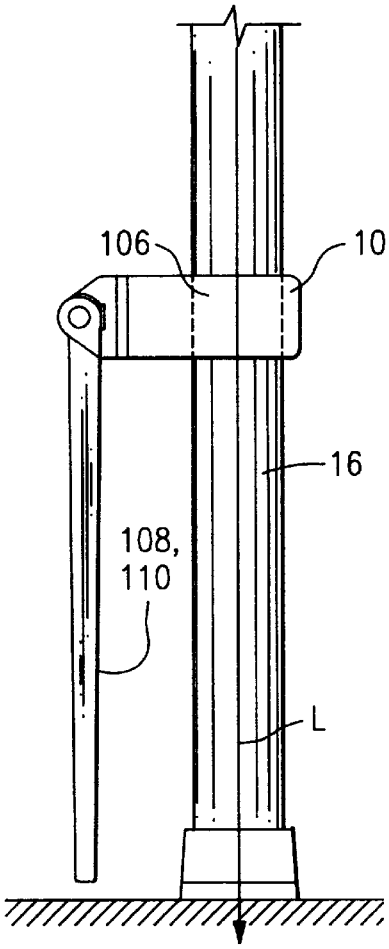
FIG. 8A is a diagrammatic side elevational view showing attachment of the kick stand support of FIG. 7 to a cane in a stowed position.
Figure 8B:
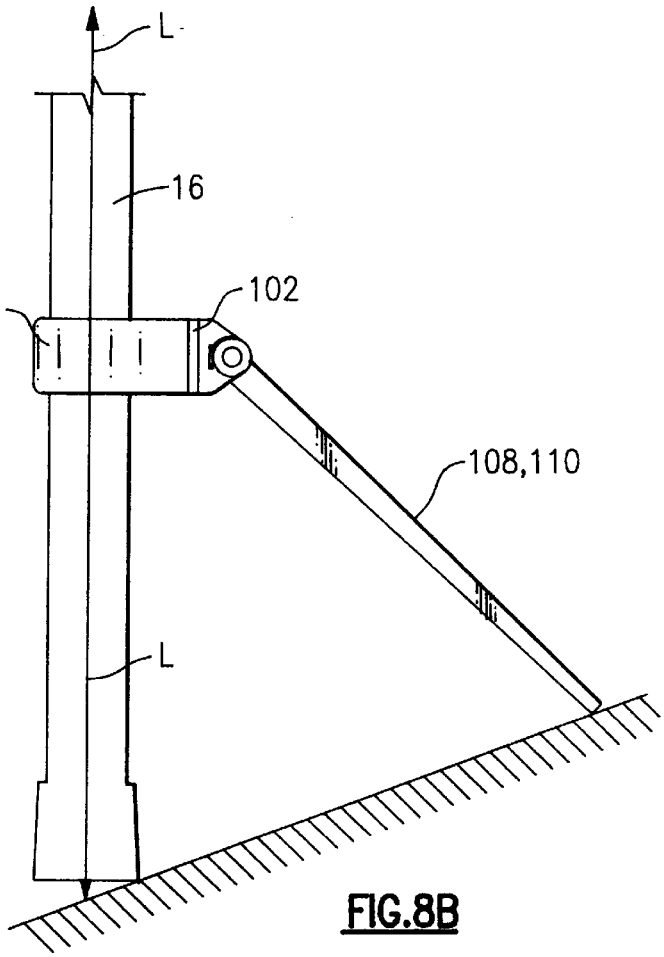
FIG. 8B is a diagrammatic side elevational view showing the use of the kick stand support of FIG. 7 to support a cane.
Figure 7:
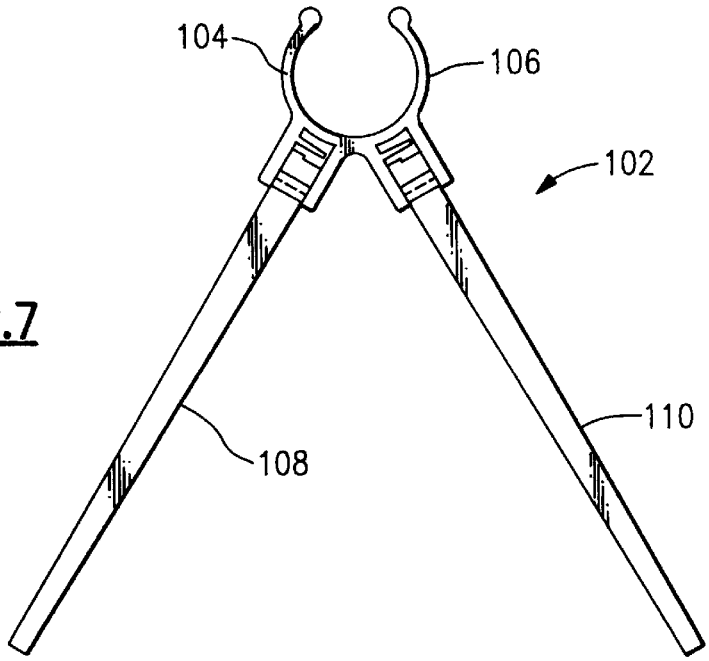
FIG. 7 is a top plan view of a kick stand support member for a cane according to the present invention.

With reference to FIGS. 7 and 8A and 8B, a detailed description concerning a kick stand support 102, for use in connection with the cane 2, according to the present invention, will now be provided. As can be seen in those Figures, the kick stand support 102 comprises a pair of spaced apart legs 104, 106. The pair of spaced apart legs 104, 106 each has an inwardly facing surface which is contoured to closely surround and encase the exterior surface of the second segment 16 and retain the kick stand support 102 at a fixed desired position along the exterior surface of the second segment 16. The kick stand support 102 pivotably supports a pair of pivotable legs 108, 110 which are allowed to pivot from a stowed position (FIG. 8A), in which the pivotable legs 108, 110 extend substantially parallel to the longitudinal axis L of the second segment 16, to a in use position (FIG. 8B) in which the pivotable legs 108, 110 extend at an angle of between approximately 40° to 50° relative to the first segment 16. When the pair of pivotable legs 108, 110 are in the "in use" position, they provide support for the cane 2, at a desired orientation with respect to a supporting surface so that the cane 2 can stand by itself on the two pivotable legs 108, 110 and the non-slip cap 10 of the shaft 4. The kick stand support 102 is provided with a pair of stop members which prevent over counterclockwise pivoting of the pivotal legs 108, 110 past the position shown in FIG. 8B. As such prevention of over pivoting is well known in the art, a further detail discussion concerning the same in not provided.

The first segment 14 has an internal diameter of about 13/16 inch or so and has an axial length of between 14 inches and 28 inches, more preferably a length of about 22 inches, while the second segment 16 has an external diameter of about ¾ inch and axial length of between 10 inches and 22 inches, more preferably an axial length of about 18 inches.

Since certain changes may be made in the above described cane, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I claim:

1. An articulable walking aid for assisting a walker, the walking aid comprising:

a hollow shaft having a top segment and a bottom segment respectively defining a top end and a bottom end;

the top end supporting a handle configured for grasping by a hand of a walker and the bottom end having a slip resistant butt end to facilitate engagement with a desired walking surface;

an actuating mechanism extending outwardly from an aperture in the hollow shaft located adjacent the top end of the shaft;

an articulating arm extending outwardly from an opening in the hollow shaft located adjacent the bottom end of the shaft;

an actuating rod being positioned within the hollow shaft, the actuating rod extending generally along a longitudinal axis of the walking aid and coupling the actuating mechanism to the articulating arm;

the articulating arm having a curvilinear range of motion such that activation of the actuating mechanism by the walker initiates a curvilinear sweeping of the articulating arm from a retracted, biased position to an extended, object engaging position;

the top and bottom segments are separate elements that telescopically engage with one another to facilitate a length adjustment of the hollow shaft;

a locking mechanism for securing the top and bottom telescoping segments in a fixed relative position; and the actuating rod has an adjustment mechanism to contemporaneously compensate for any adjustment in length of the top and bottom segments to maintain continued coupling of the actuating mechanism with the articulating arm.

2. The walking aid according to claim 1, wherein the adjustment mechanism of the actuating rod comprises a first rod portion and a second rod portion, the first rod portion affixed to the actuating mechanism and the second rod portion being affixed to the articulating arm, the first and second rod portions having complimentary serrated engagement teeth providing an adjustable demountably secure coupling of the first and second rod portions.

3. The walking aid according to claim 2 wherein the bottom segment of the shaft contains at least one detent hole, the bottom segment also having a smaller circumference than the top segment allowing the bottom segment to be telescopically inserted within the top segment;

a detent having an inwardly protruding button, the detent springably secured to the first segment of the shaft;

a plurality of through holes situated along the top segment, the through holes being alignable with the at least one detent hole for cooperatively accepting the inwardly protruding button of the detent, and the bottom segment is affixed in relative immobility in relation to the top segment providing a certain longitudinal length to the shaft, the aligned holes permitting the engagement of the detent button in order that a walker may easily vary the length of the shaft; and a clamping collar situated on a second end of the first segment of the shaft, the collar ring providing a reinforcing clamping between the top and bottom segments of the shaft to further secure the certain longitudinal length to the shaft.

4. The walking aid according to claim 3 wherein the inwardly protruding button of the detent clip penetrates a through hole and the detent hole, immobilizes the top and bottom segments of the shaft, and applies sufficient pressure to establish immovable engagement between the serrated teeth of a first and second rod portions of the adjustment rod.

5. An articulable walking aid for assisting a walker, the walking aid comprising:

a hollow shaft having a top segment and a bottom segment respectively defining a top end and a bottom end;

the top end supporting a handle configured for grasping by a hand of a walker and the bottom end having a slip resistant butt end to facilitate engagement with a desired walking surface;

an actuating mechanism extending outwardly from an aperture in the hollow shaft located adjacent the top end of the shaft;

an articulating arm extending outwardly from an opening in the the hollow shaft located adjacent the bottom end of the shaft;

an actuating rod being positioned within the hollow shaft, the actuating rod extending generally along a longitudinal axis of the walking aid and coupling the actuating mechanism to the articulating arm;

the articulating arm having a curvilinear range of motion such that activation of the actuating mechanism by the walker initiates a curvilinear sweeping of the articulating arm from a retracted, biased position to an extended, object engaging position;

wherein the bottom segment includes a cam integral with the opening located adjacent the bottom end, the cam contacts a camming surface of the articulating arm when the articulating arm is extended such that a range of motion of the articulating arm is defined by an interaction between the cam and camming surface.

6. The walking aid according to claim 5 wherein the range of motion of the articulating arm includes a retracted position where the articulating arm is retractably positioned adjacent the bottom segment and spaced from the end of the shaft;

an engaged position where the articulating arm is adapted to be influenced into engagement juxtaposed the bottom end; and an intermediate position, defined as the articulating arm moves from the retracted position toward the engaged position.

7. The walking aid according to claim 6 wherein the range of motion of the arm is induced via the actuating mechanism influencing the arm from the retracted position, in a generally curvilinear motion relative to the shaft to the intermediate position wherein an opposed engagement portion of the arm extends beyond the bottom end of the shaft.

8. The walking aid according to claim 7 wherein the range of motion includes a second intermediate position defined by a linear movement of the opposed engagement portion of the arm.

9. The walking aid according to claim 7 wherein the engaged position is established by a secure variable tensioned gripping by the opposed engagement portion.

10. A cane with a pivoted arm to facilitate retrieving a desired object by operation of the pivoted arm, said cane comprising:

an elongate shaft having a first end and an opposed second end;

a handle being secured adjacent the first end of the shaft and the second end of the shaft supporting a pivoted arm for facilitating retrieval of a desired object;

a trigger mechanism, located adjacent said handle, being coupled to said pivoted arm by an internal coupling mechanism to facilitate pivoting motion of the pivoted arm via operation of the trigger mechanism; and the pivoted arm pivoting about an axially moveable pivot point between a fully retracted position in which the pivoted arm is at least partially housed within the shaft, an extended position in which the pivoted arm is able to sweep across a desired floor surface and an engaged position grasping a desired article.

11. The cane according to claim 10, wherein the internal coupling mechanism comprises a second internal coupling mechanism, supporting the pivoted arm, and a first internal coupling mechanism, coupled to the trigger mechanism, and the second internal coupling mechanism and the first internal coupling mechanism are releasably fastened to one another.

12. The cane according to claim 11, wherein the cane is a telescopic cane having a first segment and a second segment and an adjustment mechanism for retaining the relative adjusted position between the first and second segments.

13. The cane according to claim 12, wherein a slot is provided in the second segment of the cane and the pivoted arm is at least partially housed within the slot, when the pivoted arm is in a retracted position, and the pivoted arm extends out through the slot when in the pivoted arm is in an extended position.

14. The cane according to claim 13, wherein the second internal coupling mechanism and the first internal coupling mechanism are both provided with an adjustment mechanism which facilitates adjustment of a length of the second internal coupling mechanism relative to the first internal coupling mechanism to facilitate operation of the pivoted arm by the trigger mechanism.

15. The cane according to claim 14, wherein at least one of the second internal coupling mechanism and the first internal coupling mechanism is provided with a plurality of centering rails to facilitate centering of at least one of the second and first internal coupling mechanisms within the cane during actuation.

16. The cane according to claim 15, wherein the second internal coupling mechanism is biased by a spring towards the bottom end of the cane to continuously bias the pivoted arm toward its extended position.

17. The cane according to claim 16, wherein the first internal coupling mechanism supports a detent arrangement, which engages with an aperture provided in the first segment of the shaft, to facilitate locking of the first internal coupling mechanism in a locked position whereby the pivoted arm is retained in its retracted position.

* * * * *